United States Patent [19]

Hosouchi et al.

[11] Patent Number: 4,935,966

[45] Date of Patent: Jun. 26, 1990

[54] SMOKEPROOF FOLDABLE BAG

[76] Inventors: Kinzi Hosouchi, 2563-21, Takaragi-cho 2-chome, Utsunomiya-shi, Tochigi-Ken; Youhiko Hosouchi, 1020-16, Nishi-kawada-machi, Utsunomiya-shi, Tochigi-ken 321-01, both of Japan

[21] Appl. No.: 294,771

[22] Filed: Jan. 6, 1989

[30] Foreign Application Priority Data

Oct. 3, 1988 [JP] Japan ..... 63-247460

[51] Int. Cl.[5] ..... A42B 1/00

[52] U.S. Cl. ..... 2/202; 2/171; 2/410

[58] Field of Search ..... 2/4, 5, 6, 7, 171, 173, 2/174, 202, 205, 206, 410, 418, 419

[56] References Cited

U.S. PATENT DOCUMENTS

| | | | |
|---|---|---|---|
| 143,610 | 1/1946 | Maxwell et al. | 2/202 X |
| 1,398,165 | 11/1921 | Whiteside | 2/171 |
| 1,752,172 | 3/1930 | Gust | 2/171 X |
| 1,996,367 | 4/1935 | Davis | 2/174 |
| 2,294,593 | 9/1942 | Bailey | 2/4 X |
| 2,445,487 | 7/1948 | Lester et al. | 2/174 |
| 2,484,269 | 10/1949 | Carlson | 2/174 |
| 2,835,899 | 5/1958 | Monro et al. | 2/202 |
| 2,837,746 | 6/1958 | Gundy | 2/205 X |
| 2,855,603 | 10/1958 | Zito | 2/173 X |
| 2,869,132 | 1/1959 | Drummond | 2/4 |
| 2,870,451 | 1/1959 | Brodsky | 2/202 |
| 4,236,514 | 12/1980 | Moretti | 2/6 X |
| 4,285,068 | 8/1981 | Ross | 2/202 |
| 4,411,023 | 10/1983 | Pinson | 2/205 X |
| 4,502,157 | 3/1985 | Wona | 2/202 |
| 4,589,408 | 5/1986 | Singer | 2/173 X |
| 4,665,567 | 5/1987 | Dilger | 2/174 |
| 4,710,756 | 12/1987 | Thornburg et al. | 2/202 X |
| 4,722,100 | 2/1988 | Greer | 2/174 |
| 4,870,959 | 10/1989 | Reisman et al. | 2/205 X |

FOREIGN PATENT DOCUMENTS

| | | | |
|---|---|---|---|
| 192357 | 5/1955 | Austria | 2/202 |
| 2105177 | 3/1983 | United Kingdom | 2/202 |
| 2207338 | 2/1989 | United Kingdom | 2/410 |

*Primary Examiner*—Werner H. Schroeder
*Assistant Examiner*—Jeanette E. Chapman
*Attorney, Agent, or Firm*—Flynn, Thiel, Boutell & Tanis

[57] ABSTRACT

A smokeproof foldable bag comprises a smokeproof foldable bag having a plurality of peak and valley lines; the smokeproof foldable bag having an open end when unfolded, a plurality of cards respectively oppositely fixed to portions adjacent to the open end of the smokeproof foldable bag; the smokeproof foldable bag being usually folded along the peak and valley lines and held by a plurality of cards; whereby the foldable bag is used by people for preventing them from sucking a smoke at the time of fire.

9 Claims, 2 Drawing Sheets

SMOKEPROOF FOLDABLE BAG

BACKGROUND OF THE INVENTION

1. Field of the Invention

The present invention relates to a smokeproof foldable bag enabling people to avoid sucking or inhaling smoke generated by a fire so that the people can take a safe refuge, and particularly to a smokeproof foldable bag which is usually portable and carried in a card case.

2. Description of the Prior Art

Death in most fire accidents is primarily caused by suffocation due to smoke inhalation. To cope with the fire accident it is very important and inevitable to take measures against the smoke.

Conventionally, a person met with a fire accident is likely to take refuge by covering their entire body by a cover material. Such covering material is per se heavy and bulky so that they are installed in a hotel and the like for an unexpected fire accident. It they are not installed there, people can not utilize them.

Inasmuch as the cover material is heavy and bulky it is normally impossible for people to carry such with them for providing refuge in an unexpected fire accident.

SUMMARY OF THE INVENTION

It is therefore the object of the present invention to provide a smokeproof foldable bag which can be conveyed with simplicity and carried in a card case in the same manner as those carried by many people in daily life.

To achieve the above object, the present invention comprises: a smokeproof foldable bag having a plurality of peak and valley lines, the smokeproof foldable bag having an open end when unfolded; a plurality of cards respectively oppositely fixed to portions adjacent to the open end of the smokeproof foldable bag; the smokeproof foldable bag being usually folded along the peak and valley lines and held by the plurality of cards; whereby the foldable bag is used by people for preventing them from inhaling smoke at the time of fire.

The above and other objects, features and advantages of the present invention will become more apparent from the following description taken in conjunction with the accompanying drawings.

DESCRIPTION OF THE DRAWINGS

FIG. 2(*b*) shows the smokeproof foldable bag 1 after it has been laterally folded and then being vertically folded to become the final size of the card 2.

PREFERRED EMBODIMENT OF THE INVENTION

Figure 1:
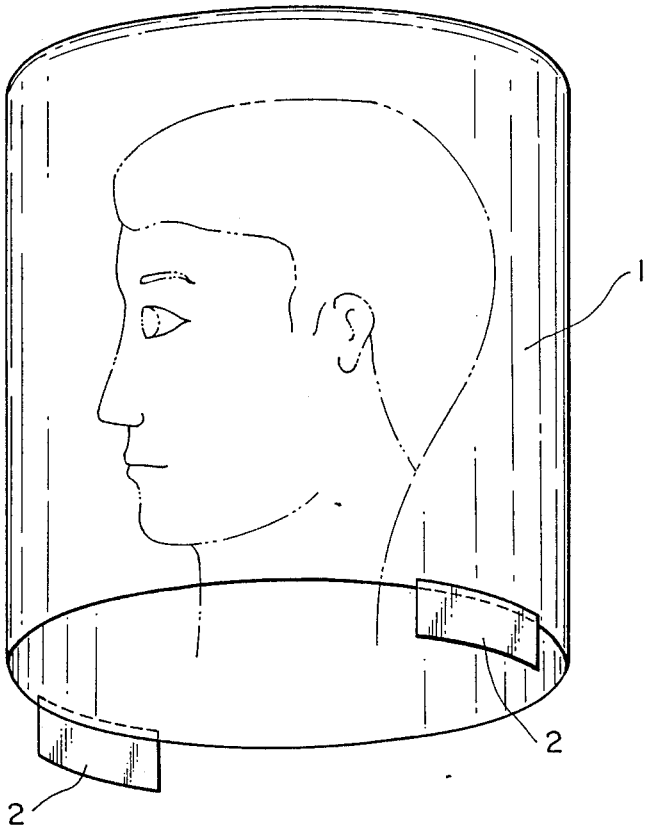
FIG. 1 is a perspective view of the smokeproof foldable bag 1.

A preferred embodiment of the present invention will be described with reference to FIGS. 1 and 2(*a*), (*b*).

A smokeproof foldable bag 1 is made of a synthetic resin film such as a polypropylene, etc. which is highly transparent so that people can easily see into and out of the bag at the time of fire. The smokeproof foldable bag 1 is as thin and light as possible to be convenient for conveyance. A person puts on the smokeproof foldable bag 1 over his head (see FIG. 1) to take refuge at the time of fire. Hence, the smokeproof bag 1 has a volume which is sufficient to afford an adequate amount of air to respire for a temporary period of time as necessary for the refuge.

Provided fixedly at the open end of the smokeproof foldable bag are two cards 2 opposed to each other. When using the smokeproof foldable bag 1, the two cards are held and waved by both hands so that the bag 1 spreads open. When folding the smokeproof foldable bag 1 is not in use, it can be folded to the extent that it can be held folded between the two cards. The smokeproof foldable bag 1 can be stored and carried in a card case (not shown) which is always carried with the person.

Figure 2A:
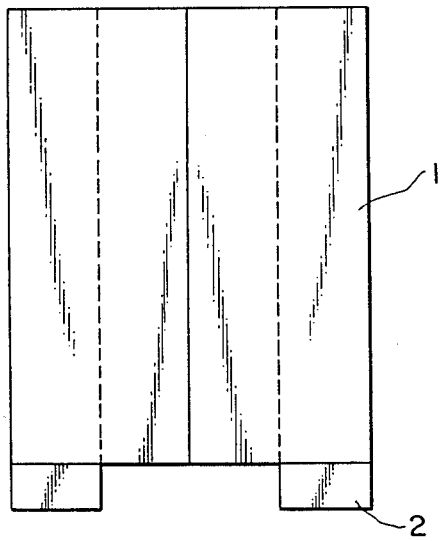
FIG. 2(*a*) shows the smokeproof foldable bag 1 formed by a plurality of long pieces partitioned by alternating peak and valley folding lines staggered with each other.
Figure 2B:
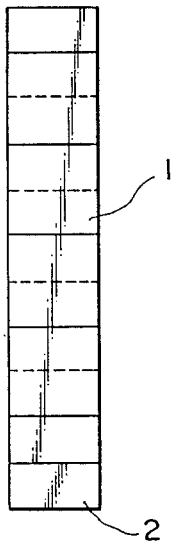

The smokeproof foldable bag is typically folded in the manner illustrated in FIGS. 2(*a*), (*b*). Peak and valley folding lines or folds, are respectively illustrated as solid and dotted lines. As shown in FIG. 2(*a*), the smokeproof folding bag 1 is formed by a plurality of long pieces or sections respectively partitioned by alternating peak and valley folding lines staggered with each other. The smokeproof folding bag 1 is first laterally folded as shown in FIG. 2(*a*) resulting in a stacked overlapping of the long pieces, and then vertically folded as shown in FIG. 2(*b*) to become finally the size of the cards 2. The smokeproof folding bag 1 can be held by the cards 2 in the manner that the cards 2 are respectively folded back into contact with the respective external sides of the now completely folded smokeproof bag 1.

Thus, the smokeproof foldable bag, for providing refuge against accidental fire can be conveniently carried in the card case.

It is convenient for people to have the smokeproof foldable bag with them at all times since a typical card case is carried by most people in a daily life, for storing business cards, etc.

The smokeproof foldable bag is utilized by many people since it has a simple construction and can be obtained at low cost.

Although the invention has been described in its preferred form with a certain degree of particularity, it is to be understood that many variations and changes are possible in the invention without departing from the scope thereof.

What is claimed is:

1. A portable smokeproof bag comprising:

a smokeproof foldable bag having a plurality of respectively inwardly and outwardly opening peak and valley folds formed therein, the smokeproof foldable bag having an opening at an open end thereof which is accessible when said bag is unfolded;

a pair of cards fixed to respective portions of said bag adjacent to the open end, said cards being located substantially oppositely across said opening from each other;

the smokeproof foldable bag, when not in use, being normally folded along the peak and valley folds and held, as folded, sandwiched between said cards; and the foldable bag, when unfolded, being adapted to receive a person's head therein through said opening for use in preventing smoke inhalation during a fire.

2. A smokeproof foldable bag according to claim 1, wherein only two of said cards are provided.

3. The device according to claim 2, wherein said cards project outwardly beyond the open end of the bag.

4. The device according to claim 1, wherein said smokeproof foldable bag is made from a transparent synthetic resin film.

5. The device according to claim 4, wherein said synthetic resin is polypropylene.

6. The device according to claim 1, wherein said smokeproof foldable bag includes a closed end open opposite said open end, said peak and valley folds extending substantially parallel to each other from said open end toward said closed end and being substantially evenly spaced from each other.

7. The device according to claim 6, wherein said peak and valley folds are arranged alternatingly in said bag and are spaced from each other by an amount substantially equal to a width of said card.

8. The device according to claim 7, wherein said cards have a size and shape approximately the same as an ordinary business card, and wherein said bag is also folded across said peak and valley folds in a direction from said closed end toward said open end when held between said cards.

9. The device according to claim 8, wherein each said card is fixed along an edge thereof to said bag, said cards depending from said open end of said bag.

* * * * *

UNITED STATES PATENT AND TRADEMARK OFFICE

CERTIFICATE OF CORRECTION

PATENT NO. : 4 935 966

DATED : June 26, 1990

INVENTOR(S) : Kinzi HOSOUCHI et al

It is certified that error appears in the above-identified patent and that said Letters Patent is hereby corrected as shown below:

Column 2, line 49; after "smokeproof" insert ---foldable---.

Column 3, line 14; delete "open".

Signed and Sealed this

Fourth Day of February, 1992

*Attest:*

*Attesting Officer*

HARRY F. MANBECK, JR.

*Commissioner of Patents and Trademarks*